US005199510A

United States Patent [19]

Stanley et al.

[11] Patent Number: 5,199,510

[45] Date of Patent: Apr. 6, 1993

[54] RAISE BORING HEAD AND STEM ASSEMBLY METHOD

[75] Inventors: John M. Stanley; Gregory L. Hern, both of Arlington, Tex.

[73] Assignee: Baker Hughes Incorporated, Houston, Tex.

[21] Appl. No.: 704,027

[22] Filed: May 22, 1991

[51] Int. Cl.[5] ..... E21D 3/00

[52] U.S. Cl. ..... 175/53; 175/325.6; 299/33; 299/55

[58] Field of Search ..... 175/53, 344, 325.4–325.6, 175/346, 374, 386, 406, 424, 53; 299/33, 55, 95

[56] References Cited

U.S. PATENT DOCUMENTS

| | | | |
|---|---|---|---|
| 2,846,093 | 8/1958 | Densmore . | |
| 3,198,087 | 8/1965 | Potts et al. | 299/33 X |
| 3,792,787 | 2/1974 | Maloney . | |
| 3,828,862 | 8/1974 | Debell et al. | 299/33 X |
| 3,983,949 | 10/1976 | Pozniko . | |
| 4,011,019 | 3/1977 | McDonald et al. | 175/53 X |
| 4,069,878 | 1/1978 | Chitwood et al. | 175/53 |
| 4,069,878 | 1/1978 | Chitwood et al. . | |
| 4,089,100 | 5/1978 | Berry, Jr. . | |
| 4,114,322 | 9/1978 | Greenspan | 175/379 X |
| 4,179,000 | 12/1979 | Mitchell et al. | 175/53 |
| 4,228,863 | 10/1980 | Liljekvist et al. | 175/53 X |
| 4,228,863 | 10/1980 | Liljekvist et al. . | |
| 4,422,228 | 12/1983 | Chapman et al. . | |
| 4,832,135 | 5/1989 | Walk et al. . | |
| 5,060,405 | 10/1991 | Siffrin et al. . | |

FOREIGN PATENT DOCUMENTS

| | | | |
|---|---|---|---|
| 1164424 | 6/1985 | U.S.S.R. | 175/53 |
| 1252494 | 8/1986 | U.S.S.R. | 175/53 |

OTHER PUBLICATIONS

Reed Mining Tools, Inc. Technical Bulletin, Assembling and Disassembling the Taper Lok Raise Boring Head.

*Primary Examiner*—Ramon S. Britts
*Assistant Examiner*—Roger J. Schoeppel
*Attorney, Agent, or Firm*—Felsman, Bradley, Gunter & Dillon

[57] ABSTRACT

An improved method for assembling a stem within a mating, close fitting hole of a raise boring head by attaching an overhead beam to the body of the raise boring bit, supporting the stem with its longitudinal axis aligned with that of the beam and that of the mating hole, and moving the stem along its axis to assemble the stem in the mating hole. A coating of wear resistant material on selected regions of the stem employs a softer material than that of the stem or the mating hole to minimize damage to the hole during assembly.

8 Claims, 6 Drawing Sheets

RAISE BORING HEAD AND STEM ASSEMBLY METHOD

BACKGROUND OF THE INVENTION

1. Field of the Invention

This invention relates to earth boring and mining—especially to methods and apparatus for assembling underground a stem to the bit body of a raise boring head.

2. Background Information

Raise boring is a method of drilling a shaft between a tunnel and the surface of the earth or between two tunnels. A raise boring bit or head is employed with a stem attached to a drill pipe in a pilot hole. A drill rig at the surface pulls and rotates the pipe and stem to urge rotatable cutters upwardly into the earth. The cuttings fall into the shaft and are removed by rail car or other means.

The stem, raise boring head and cutters are often lowered separately into the tunnel, where they are then assembled in preparation for drilling. Some successful raise boring bits have stems and heads assembled by interference fit or other techniques using close fits between the interconnecting regions of the stems and heads. Care must be exercised to minimize damage to these close fitting, interconnecting regions prior to and during assembly. Damage can result from misalignment of the stem and head during assembly. The stem often has a hardfaced region that must pass through the head during assembly. Inaccurate alignment may damage the accurately finished region.

U.S. Pat. No. 4,069,878 discloses a raise boring bit that allows easy and effective installation and removal of a stem and head, assembled by regions of interference fit. Another method using untapered but close fitting regions is described in U.S. Pat. No. 4,228,863.

The most widely used method for installation of a stem underground is to attach a chain hoist to roof bolts in the tunnel roof. An effort is made to align the chain hoist with the centerline of the bit body. This procedure is inadequate when there is a tight fit between the wear pads and the bit body I.D. As the size of the pilot hole is increased to allow for larger diameter drill pipe, the clearance between the wear pads and existing bit body bores is decreased, and damage free installation becomes more difficult.

The slings in this prior art method can allow the stem to change position, both vertically and horizontally, and damage free assembly is tedious. A cardboard strip, temporarily placed over the hardfacing pads, has been used to minimize damage to the closely finished surfaces. But the cardboard strips have disadvantages in that they are often too thick and can be swept aside when the stem is being inserted in the bit body.

SUMMARY OF THE INVENTION

The general object of this invention is to provide an improved method for assembling underground a stem within a mating hole of a raise boring head. A support beam is attached to the body of the raise boring head, which will support the stem and align its longitudinal axis with that of the beam and that of the hole. The stem is moved along its axis to assemble the stem in the hole to minimize damage to the surface of the hole. The ends of the beam will be attached to the roof of the tunnel to support the weight of the stem during installation.

Generally, a wear resistant material is applied to selected regions of the stem to inhibit wear during boring. A coating over the wear resistant material employs a softer material than that of the tapered region of the stem or the mating hole to minimize damage to the hole during assembly.

Additional objects, features and advantages of the invention will become apparent in the following description.

DESCRIPTION OF THE PREFERRED EMBODIMENT

Figure 1:
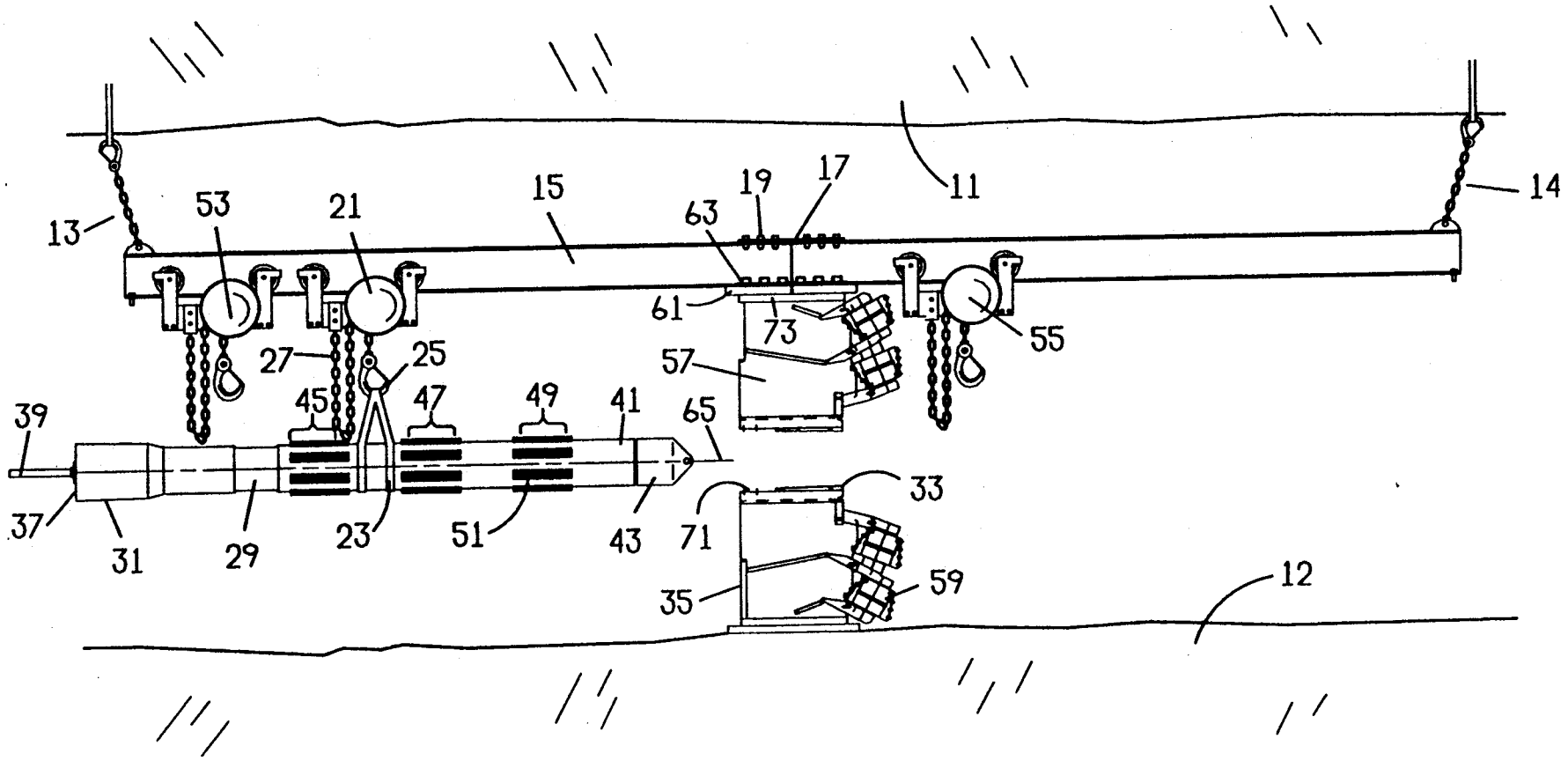
FIG. 1 is an side elevational view, partially in section, of an elongated stem, raise boring head (partially in section) and overhead beam with hoists positioning the stem in an initial stage of assembly.

Referring initially to FIG. 1, the numeral 12 designates the floor of an underground tunnel which supports the body 57 of raise boring head 35. The numeral 11 designates the roof above floor 12 with support means 13 and 14 to support an overhead beam 15 that is commonly formed in two sections joined by a plate 17 and fasteners 19.

The beam 15 supports hoist means 21, here a first chain hoist conventional in configuration, to move along a length of the beam. The hoist supports a sling 23 that may be raised or lowered by the hook 25 and chain 27.

The sling 23 surrounds a midregion of an elongated stem 29 which has a tapered, here conical region 31 that is to be secured by interference fit within the mating tapered, here conical sleeve 33 in the raise boring head 35.

Figure 8:
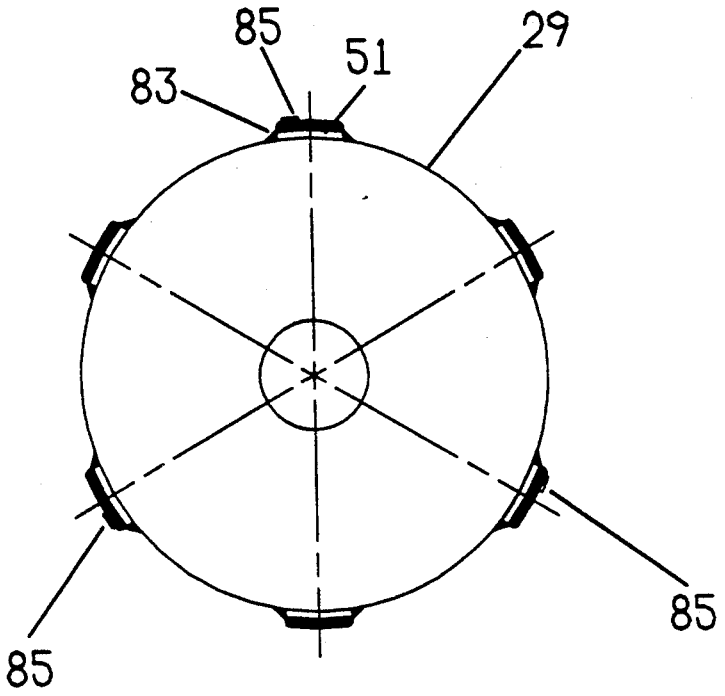
FIG. 8 is a cross-sectional view of the stem as seen looking along the line of 8—8 of FIG. 6.

Extending from the rearward end 37 of the stem 29 is an extraction stud 39. The forward end 41 of the stem 29 has a removable lifting bail 43. The extraction stud 39 and lifting bail 43 are useful to facilitate handling of the stem. Between the rearward end 37 and forward end 41 of the stem are a plurality of regions 45, 47, 49, each of which has a plurality of longitudinally extending pads 51 that have two layers of material: (1) an underlying layer of wear resistant material and (2) a covering of material softer than that of the tapered sleeve or conical region 33 of the raise boring head 35. The preferred embodiment of these pads will be explained subsequently in connection with a discussion of FIGS. 6, 7, and 8.

At the stage of installing the stem, the body 57 does not contain the stem and is not yet a complete raise boring head 35.

Also shown in FIG. 1 are additional hoist means, here a second hoist 55, and a third hoist 53, each of which is identical to the previously described first hoist 21. The tapered sleeve 33 of head 35 of FIG. 1 will be assembled with the taper 31 of stem 29 by the hoist 21, 53 and 55 that depend from the overhead beam 15. The raise boring head 35 and body 57 have a plurality of cutters 59 in addition to a central, tapered sleeve 33. Additional features of the head will be explained subsequently in connection with FIG. 2. A tapered region 31 of the stem 29 is adapted to mate by interference fit within the tapered hole 33, using the method disclosed in the above-identified publication "Assembling And Disassembling The Taper Lok Raise Boring Head" once the stem 29 and tapered hole 33 are aligned as described here.

One peripheral edge of the body 57 of the raise boring head 35 is formed with a plate 61 containing a plurality of drill holes to receive fasteners 63 that are used to attach the overhead beam 15 to the body 57. The alignment and configuration of the plate 61 are such that the longitudinal axis 65 of the tapered stem 29 coincides with that of the tapered hole in sleeve 33 in the raise boring head 57 and also is parallel with the axis of the overhead beam 15. This will enable the insertion of the stem 29 through the tapered hole 33 of the body 57 to minimize contact between the stem, and especially the pads 51 of regions 45, 47 and 49, with the hole 33. This will minimize damage to the surface of the tapered hole 33, which is finished to close tolerances and a smooth finish since it will be secured by interference fit with the tapered region 31 of the stem 29.

Figure 2:
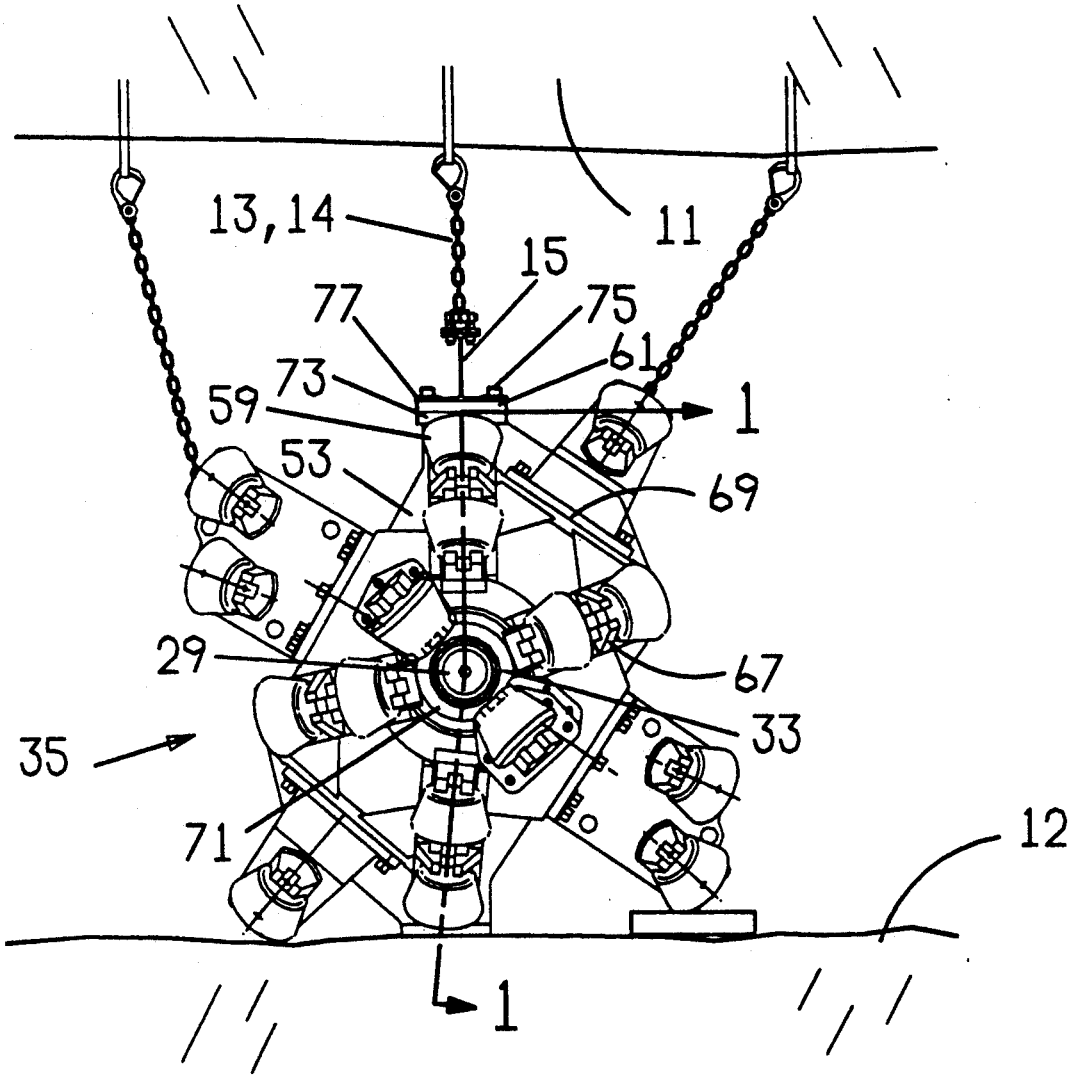
FIG. 2 is an end view of the raise boring head as seen looking from the right-hand side of FIG. 1.

Another view of the raise boring head 35 may be seen in FIG. 2. The cutters 59 are secured to body by a plurality of mounting plates 67. Mounting plates 67 are attached to rails 53 that are strengthened by wing bolt plates 69. In this view the stem 29 is seen through the tapered sleeve 33 in the hub 71. The end of each set of rails is supported by a plate 73. In addition, the attachment plate 61 is secured to the overhead beam 15. This plate is attached by welding to the overhead beam 15 such that fastener means, here bolts 75 and washers 77, may be inserted through mating holes (not shown) in the plates 61, 73.

Figure 3:
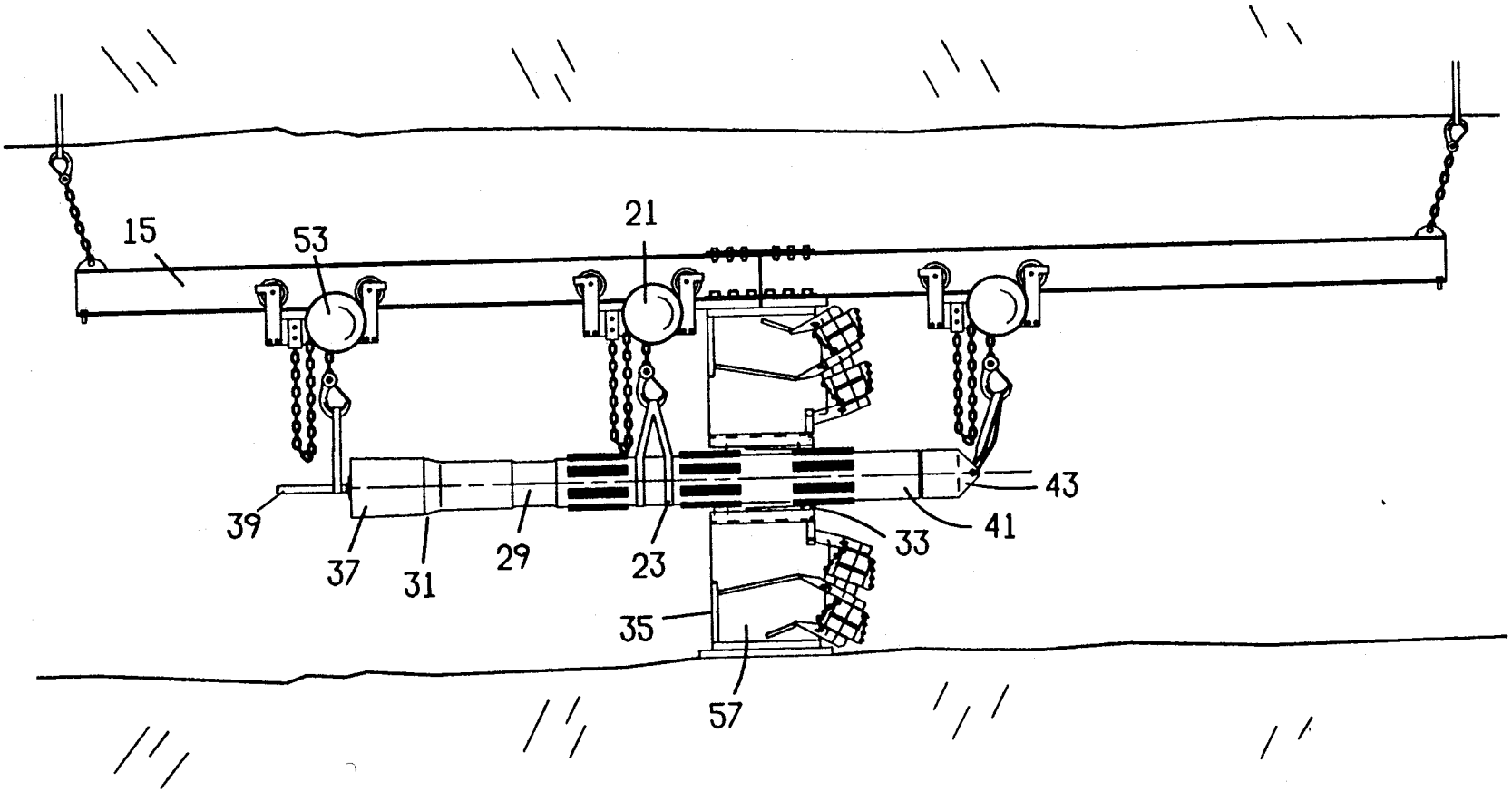
FIG. 3 is a side elevational view of the apparatus of FIG. 1 during a second step of assembly.

There are various ways to use the hoist means to insert the tapered region 31 of the stem 29 within the tapered sleeve 33 of the body 57 of the raise boring head 35. Here, however, FIG. 3 shows the apparatus of FIG. 1 after the first hoist means 21 has been moved along the beam to insert the forward end 41 and lifting bail 43 through the tapered sleeve 33 in the body 57 of the raise boring head 35 until the bail is positioned as shown. The second hoist 55 is used to support the bail 43 and forward end 41 of the stem. The third hoist 53 is used to support the extraction stud 39 and rearward end 37 of the stem 29.

Figure 4:
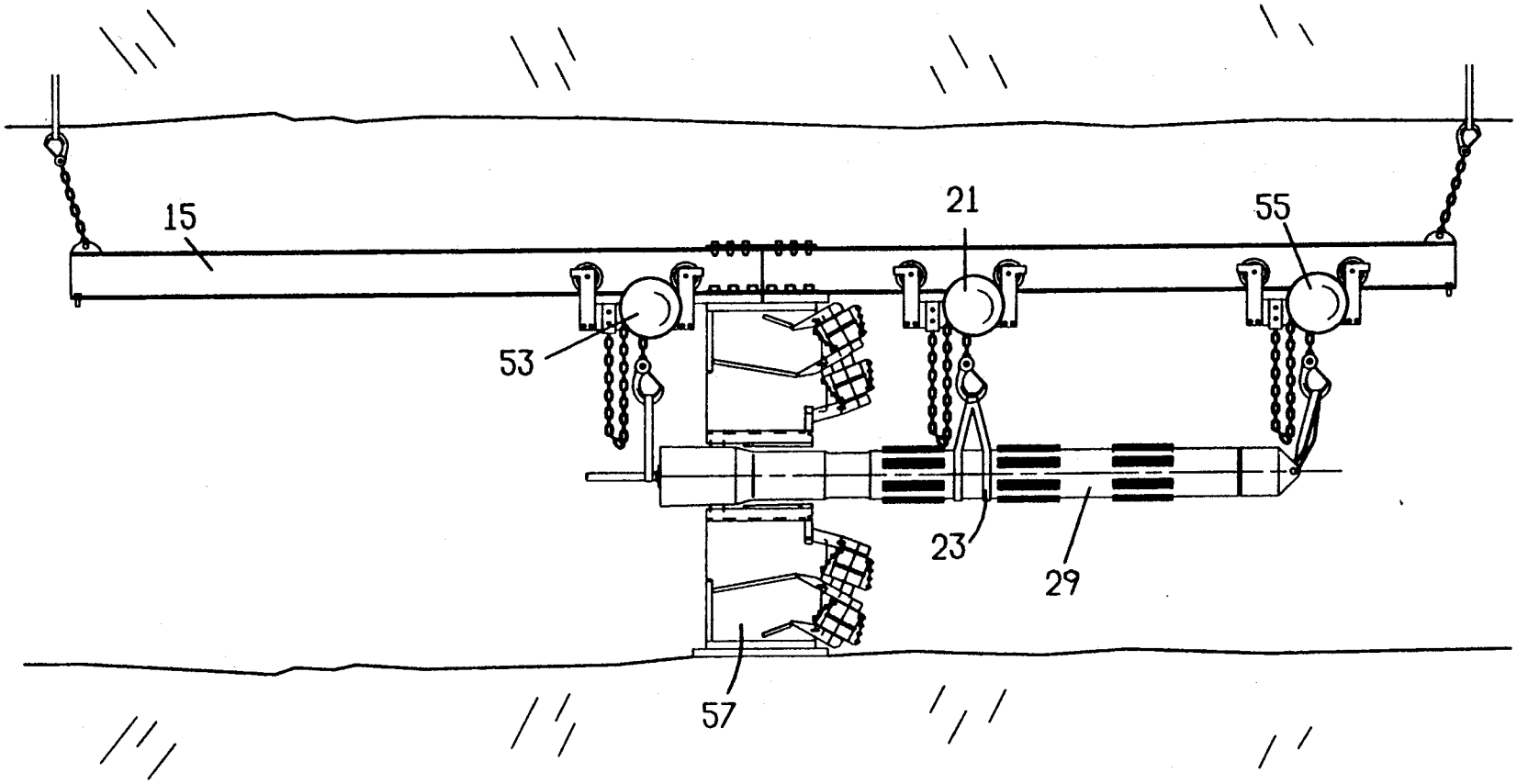
FIG. 4 is a side elevational view of the apparatus of FIG. 1 during a third step in the assembly operation.
Figure 5:
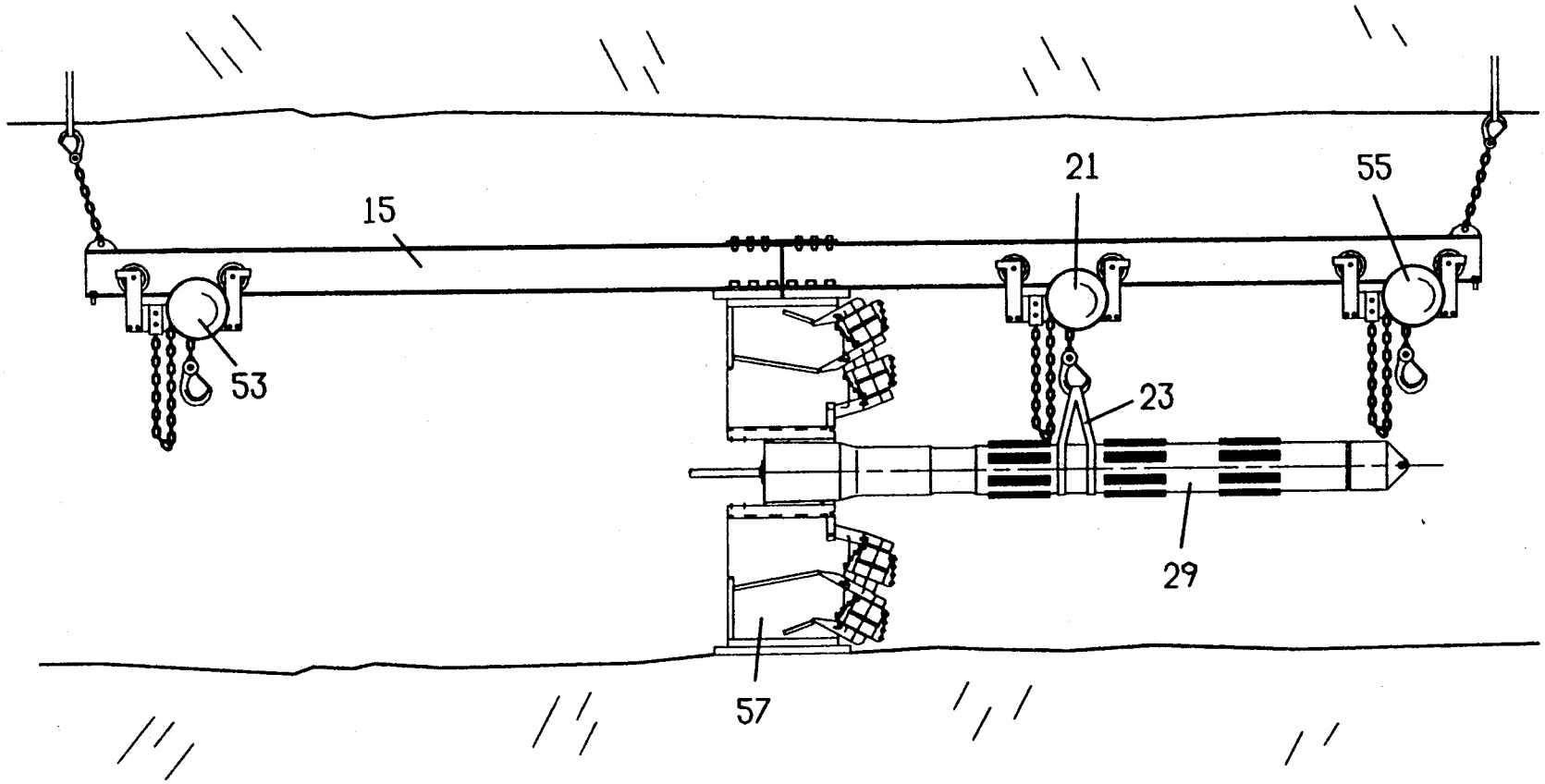
FIG. 5 is a side elevational view of the apparatus of FIG. 1 as shown during a fourth and final step in the assembly.

FIG. 4 shows the apparatus of FIG. 1 after the second hoist means 55 and third hoist means 53 have been moved along the beam to move stem 29 further through body 57. FIG. 4 also shows the first hoist 21 and its sling 23 reinstalled on the far side of body 57. FIG. 5 shows the apparatus of FIG. 1 after the first hoist means 21 has been used a second time to move stem 29 into position for installation of hydraulic tools for securing stem 29 to body 57 by interference fit.

Figure 7:
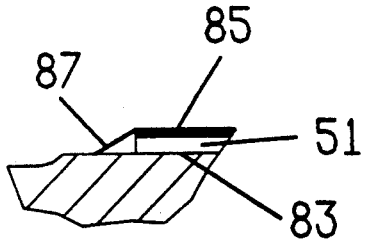
FIG. 7 is a fragmentary, enlarged view of a portion of the elongated stem of FIG. 6.
Figure 6:
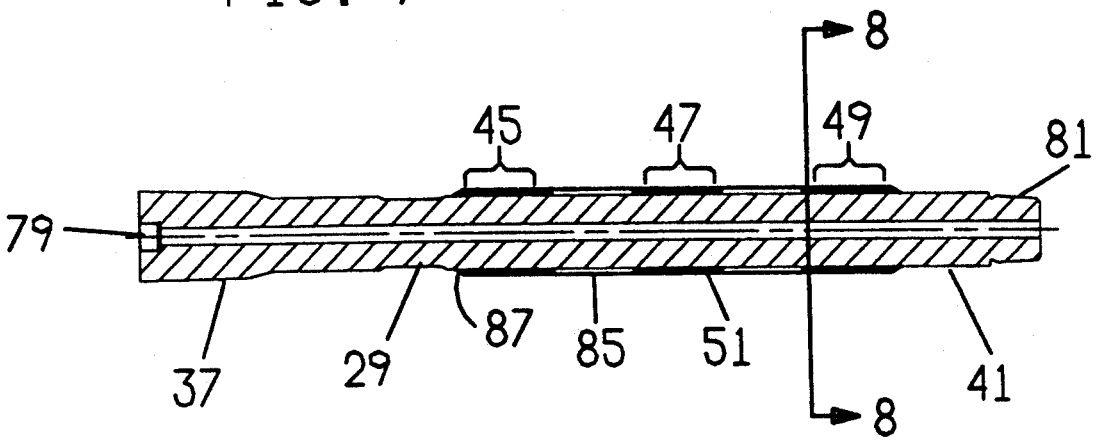
FIG. 6 is a longitudinal section of the elongated stem of FIG. 1.

As shown in FIG. 6, the stem 29 has in its rearward end 37 a threaded hole 79 to receive the extraction stud 39 shown in FIG. 1. The forward end 41 of the stem 29 has a external thread 81 to receive a portion of the lifting bail 43 shown in FIG. 1. The plurality of pads 51 are welded at 83 to the straight portion of stem 29. Copper strips 85 are brazed to one edge of selected pads, the ends 87 of which extend obliquely downwardly as shown in FIG. 7. Thus, the copper strips 85 protect the tapered hole 33 in the bit body when the tapered stem 29 is being assembled.

It should be apparent from the foregoing that we have provided an invention having significant advantages. The attachment of an overhead beam to a bit body and the use of an assembly method such that the beam 15, the stem 29 and the axis of the opening 33 in the bit body 57 are aligned simplifies assembly and minimizes damage during assembly to the close fitting surfaces between the stem and bit body. Further, the use of a covering over the wear pads on the stem further minimizes the risk of damage to the tapered hole 33 in the bit body during assembly.

While the invention has been shown in only its preferred form, it should be apparent to those reasonably skilled in the art that it is not thus limited, but is susceptible to various changes and modifications.

We claim:

1. A method for assembling an elongated stem having a forward end, a rearward end and a region to mate with a close fitting hole in the body of a raise boring head, comprising the steps of:

attaching an overhead beam to the body of the raise boring head to align the longitudinal axes of the beam and the close fitting hole;

supporting the stem by hoist means depending from the beam, with the longitudinal axis of the stem aligned with said axes of the beam and the close fitting hole;

moving the stem along its longitudinal axis with the hoist means to assemble said region of the stem with the close fitting hole in the bit body of the raise boring head.

2. The method defined by claim 1 which further comprises the steps of:

covering selected portions of the stem with a material softer than the material forming the stem or the close fitting hole in the bit body to minimize damage during assembly.

3. An improved raise boring head of the type having a stem assembled by hoist depending from an overhead beam to mate with a hole in the body of the head, the improvement comprising:

a body;

plural cutters mounted on the body;

a central hole in the body;

an elongated stem having a region adapted to mate by interference fit with the hole of the body;

the body having a plate on one peripheral edge with fastener means for attachment to the overhead beam to align the stem and the hole during assembly with the central hole in the body.

4. The raise boring head of claim 3 which further comprises a wear resistant material applied to selected regions of the stem to inhibit wear during boring.

5. The raise boring head of claim 4 wherein selected regions of the wear resistant material of the stem have a covering of material softer than the wear resistant material of the stem or the hole in the bit body to minimize damage to the hole during assembly.

6. An improved raise boring head of the type having a stem assembled with a mating hole in the body of the head, the improvement comprising in combination:

a body;

plural cutters mounted on the body;

a central hole in the body;

an elongated stem having a mating region adapted to mate by interference fit with the hole of the body;

a wear resistant material applied to selected regions of the stem to inhibit wear during boring;

a coating over the wear resistant material, employing a material softer than the material forming the mating region of the stem or the mating hole to minimize damage to the mating region or hole upon accidental contact.

7. The raise boring head of claim 6 which further comprises a plate on one peripheral edge adapted to receive fastener means for attachment of an overhead support means.

8. The raise boring head of claim 6 wherein the coating comprises a plurality of copper strips secured to selected regions containing the wear resistant material.

* * * * *